United States Patent [19]

Hatch et al.

[11] 4,341,428

[45] Jul. 27, 1982

[54] INTERCONNECTION SYSTEM FOR SHIELDED ELECTRICAL CABLE

[75] Inventors: David A. Hatch, Sherborn; Paul J. White, Holliston, both of Mass.

[73] Assignee: Pintek, Inc., Newton Upper Falls, Mass.

[21] Appl. No.: 132,821

[22] Filed: Mar. 24, 1980

[51] Int. Cl.[3] ..... H01R 13/34

[52] U.S. Cl. ..... 339/14 R; 339/91 R

[58] Field of Search ..... 339/14, 17 LC, 91 R, 339/143

[56] References Cited

U.S. PATENT DOCUMENTS

| | | | |
|---|---|---|---|
| 1,750,014 | 3/1930 | Lofgren | 339/14 R |
| 3,136,593 | 6/1964 | Ehrman et al. | 339/14 R |
| 3,329,925 | 7/1967 | Johnson et al. | 339/143 R |
| 3,904,261 | 9/1975 | Cooney | 339/14 R |
| 4,120,553 | 10/1978 | Muz | 339/143 R |

*Primary Examiner*—Joseph H. McGlynn

[57] ABSTRACT

An electrical connection system including a plug-in connector housing for receiving a shielded cable comprising multiple signal wires, a plurality of connector contacts retained by the housing and each arranged for connection to one of the signal wires, a header assembly for receiving the connector housing, a plurality of header contacts retained by the header assembly and each positioned to engage one of the connector contacts, connector ground contact means disposed externally on the connector housing and connected to the conductive shield, and header ground contact means supported by the header and shaped and arranged to engage the connector ground contact means upon reception of the connector housing by the header assembly.

28 Claims, 13 Drawing Figures

INTERCONNECTION SYSTEM FOR SHIELDED ELECTRICAL CABLE

BACKGROUND OF THE INVENTION

This invention relates generally to a system for mass termination of shielded multiple signal wires and, more particularly, to a mated connector and header assembly for that function.

Cables composed of multiple signal wires are used extensively in many electronic applications. Particularly popular are both flat and twisted flat ribbon cables that alternate ground wires with signal wires to reduce interwire cross talk. Additional protection from electrical interference is provided frequently by a shield in the form of a conductive sheet that overlies the signal wires in a cable and is connected to chassis ground. Certain problems result from the present techniques utilized to complete this ground connection.

In some systems, drain wires connected to the shield are equipped with lugs that are fastened to a chassis each time a connector terminating the cable is engaged with a mated header. This approach is rather cumbersome in that the lug must be handled in a separate operation during each connection or disconnection of the cable. In addition, the relatively small gauge drain wires are highly susceptible to damage during the connection procedures.

Other systems connect the drain wires directly to signal contacts in a connector employed to terminate a cable. This technique exhibits the disadvantage of sacrificing contacts that could otherwise be dedicated to signal wires. Furthermore, the ground connections obtained sometimes are not reliable because the drain wires generally are bare and have a tendency to float during interconnection.

The object of this invention, therefore, is to provide an improved connection system for the mass termination of shielded multiple signal wires.

SUMMARY OF THE INVENTION

The invention is an electrical connection system for use with an electrical cable having a plurality of signal wires and a conductive shield for shielding the wires from electrical interference. Included in the system is a plug-in connector housing for receiving the shielded cable, a plurality of connector contacts retained by the housing and each arranged for connection to one of the signal wires, a header assembly for receiving the connector housing, a plurality of header contacts retained by the header assembly and each positioned to engage one of the connector contacts, connector ground contact means disposed externally on the connector housing and connected to the conductive shield, and header ground contact means supported by the header and shaped and arranged to engage the connector ground contact means upon reception of the connector housing by the header assembly. The provision for an automatic, external connection between a shielded cable and a header ground contact eliminates the above-described requirements for either appropriating a signal contact to establish chassis ground or directly connecting the cable shield to the chassis each time a connector-header connection is made.

In a preferred embodiment of the invention, the header assembly includes a header body for receiving the connector housing and a latching mechanism for securing the connector housing after reception by the header body, and the header ground contact means includes a bridge contact supported by the latching mechanism and movable thereby into connection with the connector ground contact means. The use of a movable bridge contact facilitates the automatic, external connection of a cable shield to a header assembly having a configuration that is compatible with existing industry standards.

According to one feature of the invention, the bridge contact and the connector and header ground contact means are shaped and arranged to experience a wiping engagement in response to movement of the latching mechanism into its latching position. The provision of a contact arrangement that establishes a wiping action alleviates the problems associated with oxidation buildup on electrical contacts.

According to another feature of the invention, the latching mechanism comprises a pair of latching arms each of which retains a bridging contact that connects the cable shield to distinct ground contacts in the header body. The provision of redundant cable shield to chassis ground connections enhances the electrical integrity of the grounding system.

According to still another feature of the invention, the connector ground contact means comprises a conductive connector shield that covers a substantial outer surface portion of the connector housing and electrically shields the signal wires received thereby. The connector shield further reduces the possibility of electrical interference with the signals carried by the system.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
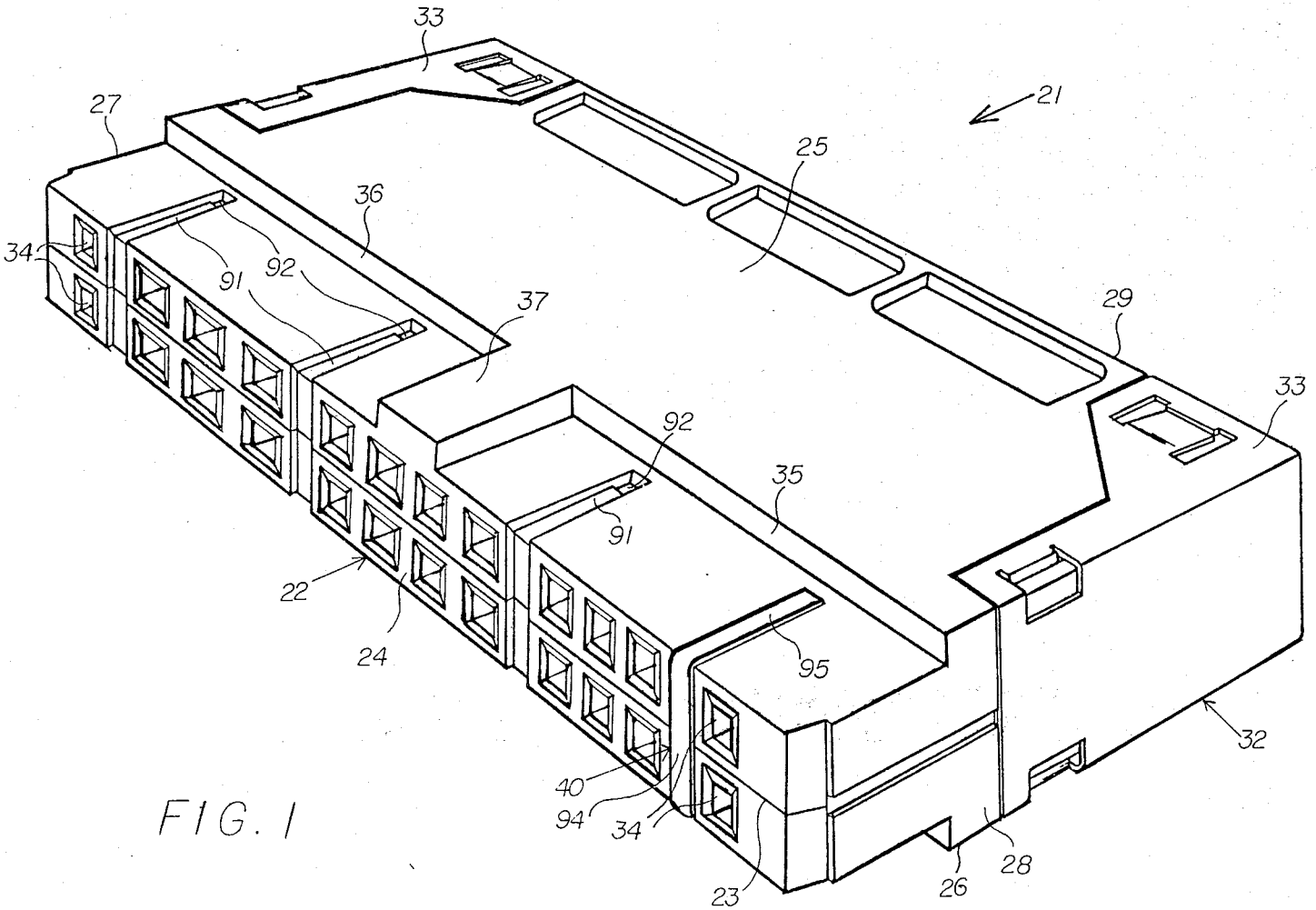
FIG. 1 is a schematic isometric view of an electrical connector constructed according to the invention.

Referring to FIG. 1, there is shown a connector 21 for terminating multiple-wire flat ribbon cables. The connector 21 includes a connector housing 22 formed by the pair of mated body halves joined together along a joint 23. Forming the outer surfaces of the connector housing 22 are a face or front surface 24, a top surface 25, a bottom surface 26, side walls 27 and 28, and a rear surface 29 adapted to permit entry of a flat ribbon cable. Each of the surfaces 24–29 is substantially rectangular so as to provide the connector housing 22 with an overall rectangular form. Retained by each of the side walls 27 and 28 is a connector ground contact 32. Terminal appendages 33 on opposite ends of the ground contacts 32 overlie and are fixed, respectively, to portions of the top and bottom surfaces 25 and 26. Defined by the front surface 24 are a plurality of uniformly spaced apart cavities 34 positioned to receive pin connectors of a mating header assembly shown in FIG. 2. Rotational alignment with that header assembly is ensured by a pair of spaced apart recesses 35, 36 that form a ridge portion 37. A connector keying element 40 is detachably secured to the housing 22 and is hereinafter described in detail.

Figure 2:
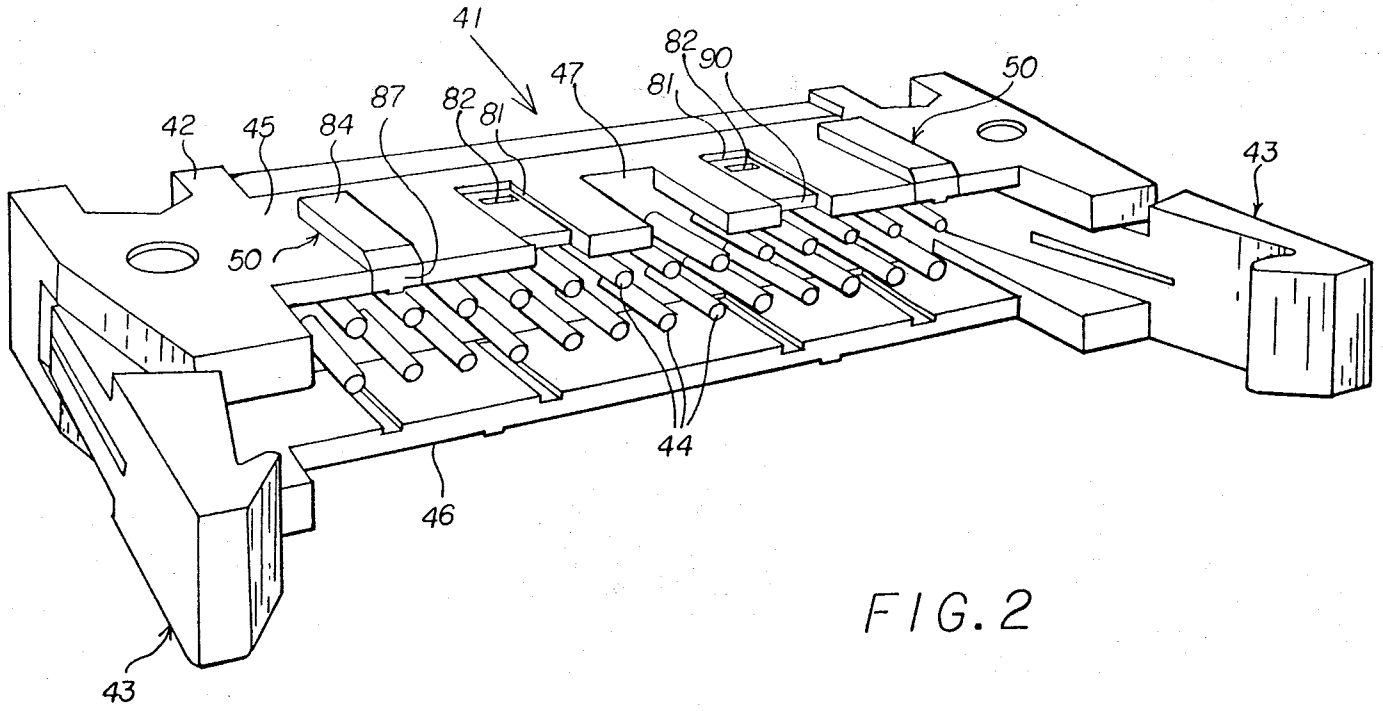
FIG. 2 is a schematic isometric view of a header assembly for use with the connector shown in FIG. 1.

Referring now to FIG. 2, there is shown a header assembly 41 formed by a header body portion 42 and latching mechanism 43 at opposite sides thereof. Retained by the body portion 42 is an array of header pin contacts 44. The header body 42 has an upper wall 45 and a spaced therefrom lower wall 46 that straddle the connector pins 44. The upper wall 45 defines a centrally located alignment slot 47 that receives the ridge 37 (FIG. 1) upon proper insertion of the connector housing 22 into the header body 42. The ridge 37 and the slot 47 prevent insertion of the connector housing 22 into the header body in the event of rotational misalignment therebetween. This feature prevents, for example, insertion of the connector housing 22 after an inadvertent 180-degree rotation thereof with respect to the header assembly 41. Detachably secured to the header body 42 and described in detail hereinafter is a header keying element 50.

Figure 4:
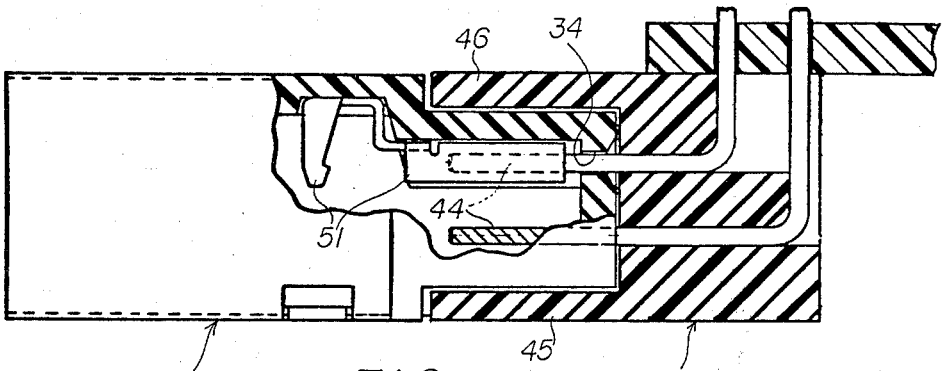
FIG. 4 is a partial schematic cross-sectional view taken along the lines 4—4 of FIG. 3.
Figure 3:
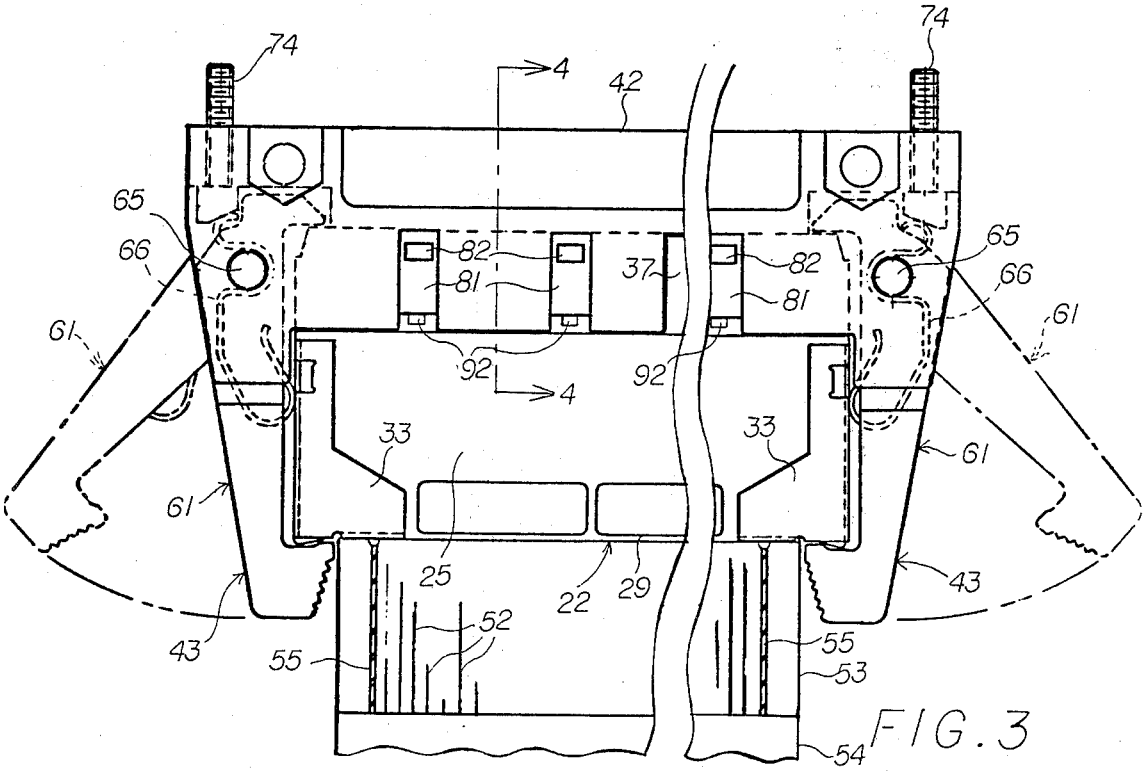
FIG. 3 is a schematic top view of the connector shown in FIG. 1 connected to the header shown in FIG. 2.

Referring now to FIGS. 3–6, there is shown a connector system in which a connector housing 22 has been plugged into a header body 42. In the arrangement illustrated, however, the keying elements 40 and 50 have been detached from, respectively, the connector housing 22 and the header body 42. After proper mating of a connector and header assembly, each of the header pin contacts 44 extend into one of the cavities 34 in the front surface 24 of the connector housing 22 and engage a connector contact 51 retained therein as shown in FIG. 4. Each of the connector contacts 51 within the connector housing 22 is connected to a different signal wire 52 of a flat ribbon cable 53 that enters an opening in the rear surface 29 of the connector housing 22. Although only a single connector contact 51 is shown in FIG. 4, it will be understood that the connector housing 22 retains a large number of the contacts 51, each of which connects a different one of the signal wires 52 to a different one of the header pin contacts 44. The specific details of those connections are not a part of this invention per se, but a description of suitable connector contacts and their use appears in U.S. Pat. No. 4,095,862. As depicted in FIG. 3, the cable 53 is equipped with an electrically conductive sheet 54 that overlies and shields the individual signal wires 52 from electrical interference. A pair of drain wires 55 connect the cover shield 54 to the ground contacts 32.

Figure 5:
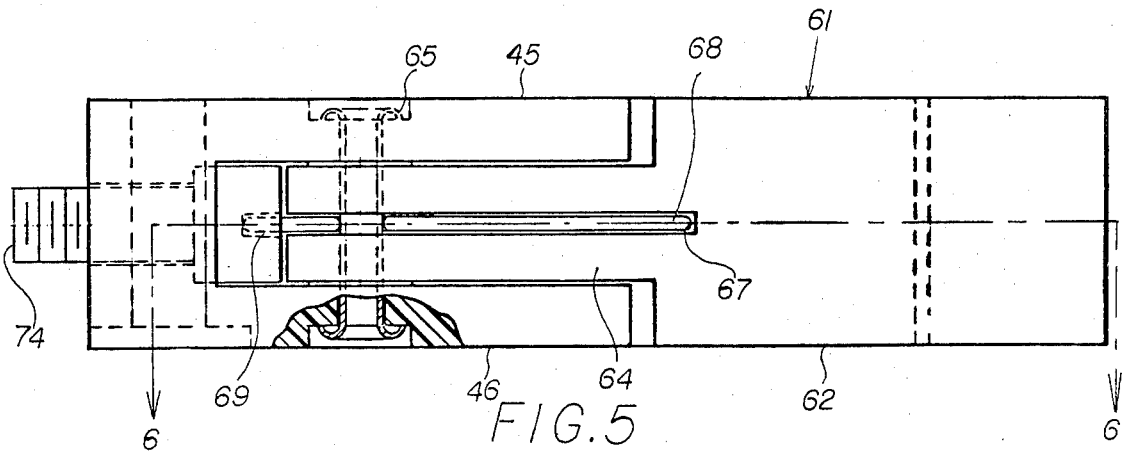
FIG. 5 is a side view of the mated connector and header arrangement shown in FIG. 3.
Figure 6:
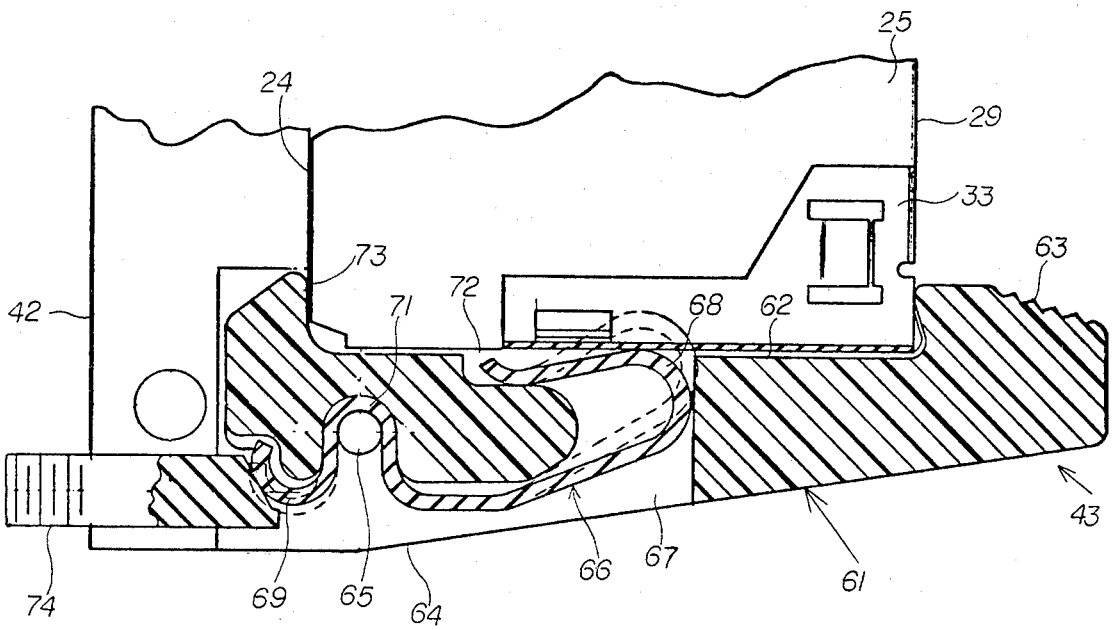
FIG. 6 is a partial schematic cross-sectional view taken along the lines 6—6 in FIG. 5.

Referring now to FIGS. 5 and 6, there is shown in greater detail one of the latch mechanisms 43 illustrated in FIGS. 2 and 3. Although only one of the latch mechanisms 43 is shown in detail, it will be understood that the two are identical. The latching mechanism 43 includes a latching arm 61 having an elongated central portion 62 straddled by a hook portion 63 and a base portion 64. Pivotally securing the base portion 64 between the upper and lower walls 45, 46 of the header body 42 is a pivot pin 65. A bridge contact 66 is retained in a recess 67 that extends between the central portion 62 and the base portion 64. Forming the bridge contact 66 is a convoluted spring member having at its opposite ends first and second U-shaped spring portions 68 and 69. The first and second spring portions 68 and 69 are joined by a U-shaped mounting portion 71 that receives the pivot pin 65 so as to retain the contact 66 within the recess 67. Defined in the inner surface of the central portion 62 is an opening 72 into the recess 67 and through which extends the first resilient spring portion 68.

Prior to entry of the connector housing 22 into the header body 42, the latching arms 61 are in open positions shown by dotted lines in FIG. 3. However, as the connector 22 enters the header body 42, the front connector surface 24 engages shoulder portions 73 extending from the base portions 64 of the latching arms 61. Further movement of the connector 22 into the header body 42 causes rotation of the latching arms 61 around the pivot pins 65 into the latched positions shown by solid lines in FIGS. 3 and 6. In those positions, the elongated central portions 62 of the latched arms 61 lie directly adjacent to the side walls 27 and 28 and the hook portions 63 of the latch arms 61 engage the rear connector surface 29 to firmly retain the connector housing 22 in place. Also, the first spring portions 68 of the bridge contacts 66 are retained in forced contact with the connector ground contacts 32 and the second spring portions 69 thereof are retained in forced contact with fixed contact studs 74 retained by the header body 42. Thus, the shield 54 on the cable 53 is electrically connected by the bridge contacts 66 to the contact studs 74 which are in turn connectable to chassis ground. During this latching operation, the first and second portions 68 and 69 of the bridge contact 66 move from their normal positions shown by dotted lines in FIG. 6 into their engaged positions shown by solid lines therein. This movement between their normal and engaged positions induces the first spring portions 68 to make sliding or wiping contacts with the connector ground contacts 32 and the second spring portions 69 to make similar wiping contacts with the contact studs 74. Because of the wiping engagement provided, oxidation is removed from the contact surfaces and a good electrical connection is established with each latching operation. When disconnection is desired, the arms 61 are pivoted outwardly about the pivot pins 65 causing the shoulder portions 73 to eject the connector 22 from the header 42.

Figure 9:
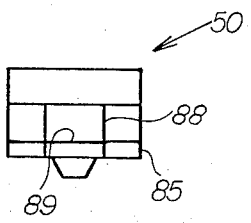
FIG. 9 is a schematic end view of the keying element shown in FIGS. 7 and 8.
Figure 7:
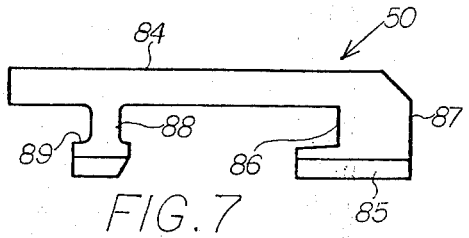
FIG. 7 is a schematic side view of a keying element used with the header of FIG. 2.
Figure 8:
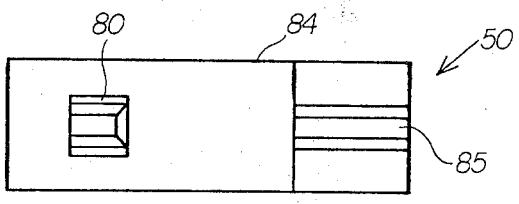
FIG. 8 is a schematic bottom view of the keying element shown in FIG. 7.
Figure 10:
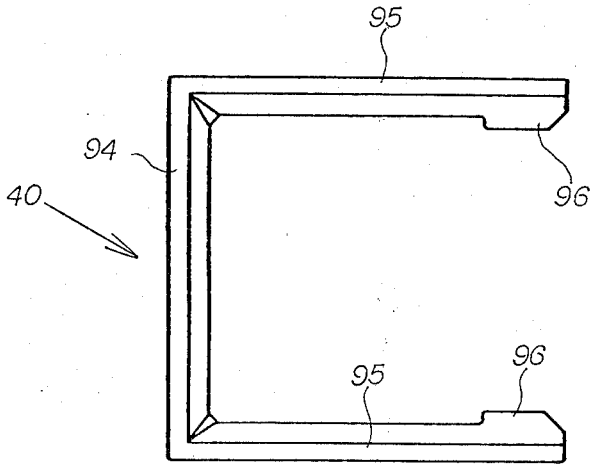
FIG. 10 is a schematic side view of a keying element used with the connector shown in FIG. 1.
Figure 11:
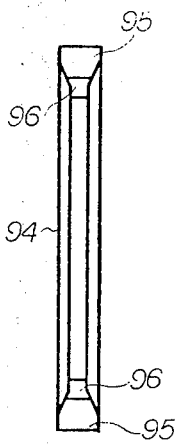
FIG. 11 is a schematic end view of the keying element shown in FIG. 10.

Referring again to FIG. 2, a plurality of spaced apart recesses 81 define given positions in the upper wall 45 of the header body 42. Associated with each of the positions 81 is a header receptacle 82 formed by an opening in the upper wall 45. Detachably secured to the header body 42 at one of the given positions 91 is the header keying element 50. As shown more clearly in FIGS. 7–9, the header keying element 50, preferably formed from a resilient plastic such as Du Pont's DELRIN plastic, comprises an elongated distortable trunk portion 84. Extending transversely from one end of the trunk portion 84 is a base that defines an inwardly directed slot 86 and an outwardly directed abutment surface 87. A tab portion 88 extends transversely from the trunk portion 84 near its opposite end and forms a shoulder 89. When a header keying element 50 is mounted on the header body 42, the trunk portion 84 is accommodated by a recess 81, the slot portion 86 receives the edge of a wall portion 90 defining the bottom of the recess 81 and the tab 88 is received by the corresponding opening 82 in the upper wall 45. The dimensions of the header keying element 50 are such that after engagement of the recessed wall portion 90 by the slot portion 86, the trunk portion 84 must be distorted to permit passage of the shoulder 89 through the opening 82. Once thus inserted, the shoulder 89 engages the bottom surface of the upper wall 45 to securely hold the header keying element 50 in the selected position 81. However, by exerting an upward pressure on the tab 88 to again distort the trunk portion 84, the header keying element 50 can be removed from the header body 42.

Figure 12:
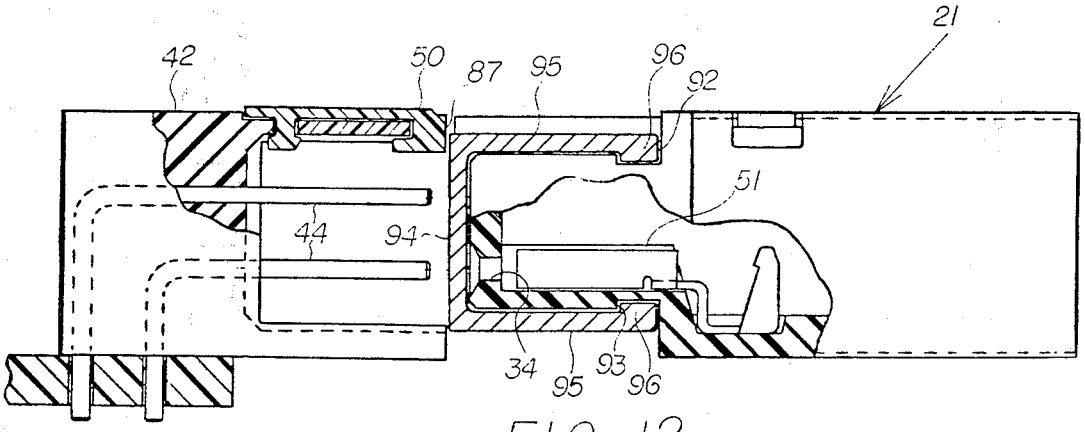
FIG. 12 is a schematic cross-sectional view similar to that shown in FIG. 4 but with the keying elements in place.

Referring again to FIG. 1, aligned grooves in the front, top and bottom surfaces 24–26 form a plurality of U-shaped grooves 91 spaced apart at particular positions on the connector housing 22. As shown in FIG. 3, each of the particular positions 91 corresponds to and is aligned with one of the given positions 81 on the header body 42. Each of the grooves 91 is terminated by an opening 92 in the top surface 25 and an opening 93 in the bottom surface 26 (FIG. 12). Detachably secured in one of the groove positions 91 is a connector keying element 40 having the form of a U-shaped clip and fabricated from a suitable spring material such as Beryluim copper. The clip 40 comprises a yoke portion 94 straddled by resilient leg portions 95. An inwardly directed tab 96 terminates each of the leg portions 95. When positioned on the connector housing 22, the yoke portion 94 overlies the front surface 24 and the tabs 96 are received by the openings 92 and 93 in, respectively, the top surface 25 and the bottom surface 26. The dimensions of the connector keying element 40 are such that upon being positioned in a particular groove 91, the tabs 96 forcibly engage the bottom surfaces thereof causing outward distortion of the leg portions 95. However, upon reaching the openings 92 and 93, the tabs 96 are forced thereinto by the resilient leg portions 95 to lock the clip element 40 in place. Subsequent removal of a keying element 40 requires separation of the leg portions 95 to remove the tabs 96 from the openings 92 and 93.

A plurality of the header keying elements 40 and the connector keying elements 50 are used to uniquely mate together given pairs of the connectors 21 and headers 41 in a connection system involving a plurality of those units. In this way, the inadvertent connection of a connector 21 into an unassociated header assembly 41 is prevented. Unique mating is established by appropriate distribution of the header keying elements 40 and the connector keying elements 50 in positions that result in engagement therebetween which in turn prevents connection between the contacts in unmated pairs of connectors and headers. Such engagement will occur between any connector keying element 40 located in one particular position 91 on a connector housing 22 and a header keying element 50 located in a corresponding given position 81 on a header body 42. For example, with the header keying element 50 in the given position 81 shown in FIG. 2 and the connector keying element 40 in the corresponding particular position 91 shown in FIG. 1, the connector housing 22 cannot be inserted completely into the header body 42 so as to produce contact between the header contacts 44 and the connector contacts 51. As illustrated in FIG. 12, complete insertion of the connector housing into the header body 42 is prevented by engagement between the yoke portion 94 of the connector keying element 40 and the abutment surface 87 of the header keying element 50.

In a properly keyed multiple unit system, none of the connector keying elements 40 will occupy in any connector any particular position 91 that corresponds to a given position 81 on a mated header in which a header keying element 50 is present. Conversely, all unmated header and connector combinations will possess at least one pair of interfering connector and header keying elements 40 and 50 that occupy corresponding key positions. In this regard, it is preferred that the connectors 21 and headers 41 be provided, respectively, with at least four particular positions 91 and four given positions 81 so as to make available a number of unique keying combinations that is a substantial multiple of the distinct key positions provided. For example, in the illustrated system involving four distinct key positions on each of the header and connector assemblies, 10 different unique keying combinations are possible.

Figure 13:
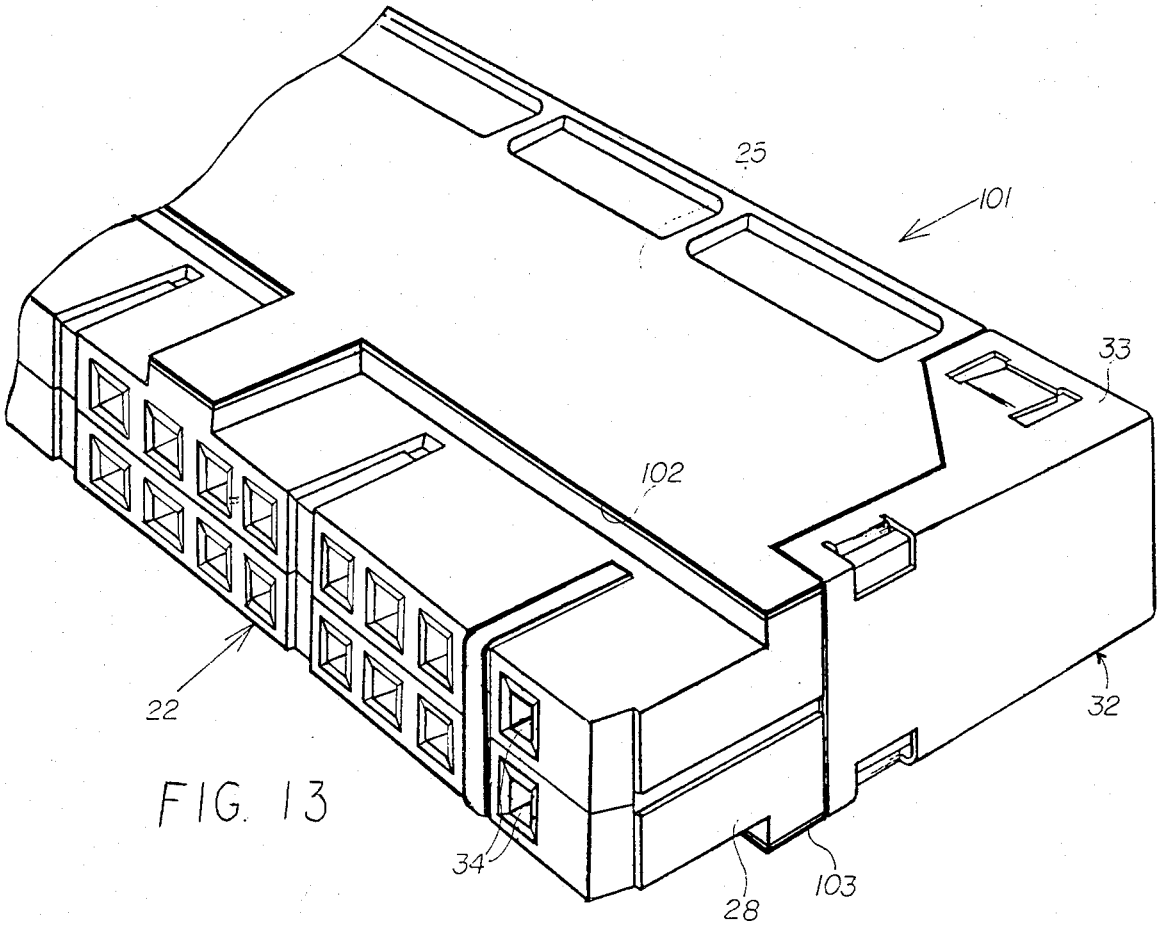
FIG. 13 is a schematic isometric view of another connector embodiment of the invention.

Referring now to FIG. 13, there is shown a connector embodiment 101 that is identical to the connector 21 of FIG. 1 except for the use of additional connector ground contact portions 102 and 103 with the ground contacts 32. Segments of the connector 101 that are identical to those of the connector 21 bear the same reference numerals. The ground contact portions 102 and 103 consist of coatings, formed with a suitable electrically conductive material, that substantially cover, respectively, the top and bottom surfaces 25 and 26 of the housing 22. During use of the connector 101 with the header unit 41 shown in FIG. 2, the ground contacts 32 function as described above to automatically connect a cable shield to chassis ground. In addition, however, the conductive coating ground portions 102 and 103 together with the contacts 32 function as a ground potential shield for the signal wires within the connector 101. Thus, the embodiment 101 provides additional protection against electrical interferences with signals carried by the assembly.

Obviously, many modifications and variations of the present invention are possible in light of the above teachings. It is to be understood, therefore, that the invention can be practiced otherwise than as specifically described.

What is claimed is:

1. An electrical connector system for use with a cable having a plurality of signal wires and a conductive shield therefor, said system comprising:

a plug-in connector housing adapted to receive the shielded cable;

a plurality of connector contacts retained by said housing and each shaped and arranged for connection to one of the signal wires;

a header means shaped and arranged to receive and retain said connector housing;

a plurality of header contacts retained by said header means and each positioned so as to engage one of said connector contacts upon reception of said connector housing by said header means;

connector ground contact means disposed externally on said connector housing and adapted for connection to the conductive shield;

header ground contact means supported by said header means and shaped and arranged to engage said connector ground contact means upon reception of said connector housing by said header means; and force producing means movable into a position that induces and maintains contact force between said connector ground contact means and said header ground contact means with said connector housing retained by said header means.

2. A system according to claim 1 wherein said header ground contact means comprises a fixed contact means adapted for connection to a circuit board chassis, and a bridge contact means for connecting said fixed contact means to said connector ground contact means; and said force producing means produces said contact force by forcing said bridge contact into forced engagement with said connector ground contact means.

3. A system according to claim 2 wherein said header means comprises a header body for receiving said connector housing; said force producing means and said header means comprise a latching means movable into a latching position engaging said connector housing after reception thereof by said header body; said bridge contact means is retained by said latching means and movable therewith; and said movement of said latching means into said latching position produces movement of said bridge contact means into contact with said connector ground contact means.

4. A system according to claim 3 wherein said movement of said latching means into said latching position also produces movement of said bridge contact means into contact with said fixed contact means.

5. A system according to claim 3 wherein said bridge contact means and said connector ground contact means are shaped and arranged to experience a wiping engagement in response to said movement of said latching means into said latching position.

6. A system according to claim 5 wherein said movement of said latching means into said latching position also produces a wiping engagement between said bridge contact means and said fixed contact means.

7. A system according to claim 6 wherein said bridge contact means comprises resilient spring portions that experience said wiping engagement with said fixed contact means and said connector ground contact means.

8. A system according to claim 4 wherein said header contacts comprise an array of pins; said connector housing comprises rectangular top and bottom surfaces joined by a pair of rectangular side walls, a rectangular rear surface, and a rectangular front surface that defines an array of cavities for receiving said pins; and said latching means comprise a pair of latch arms pivotally supported by said header body and engageable with said connector housing.

9. A system according to claim 8 wherein each of said latch arms comprises base and hook portions joined by a central portion, each of said base portions is pivotally connected to said header body by a pivot pin, and when in said latching position each of said central portions extend adjacent to a different one of said side walls and said hook portions engage said rear surface.

10. A system according to claim 9 wherein said bridge contact means and said connector ground contact means are shaped and arranged to experience a wiping engagement in response to said movement of said latching means into said latching position.

11. A system according to claim 10 wherein said movement of said latching means into said latching position also produces a wiping engagement between said bridge contact means and said fixed contact means.

12. A system according to claim 10 wherein said bridge contact means comprises a pair of bridge contacts, one retained by each of said latch arms.

13. A system according to claim 12 wherein each of said bridge contacts comprises first and second resilient contact portions joined by a mounting portion, said first contact portions experience said wiping engagement with said connector ground contact means, said second contact portions engage said fixed contact means, and said mounting portions are pivotally supported by said pins.

14. A system according to claim 13 wherein said connector ground contact means comprise a connector ground contact retained by each of said side walls.

15. A system according to claim 14 wherein each of said latch arms have a recess retaining one of said bridge contacts and defining an opening adjacent to one of said side walls, and said first contact portions extend out of said openings to engage said connector ground contacts.

16. A system according to claim 15 wherein said fixed contact means comprise conductive studs supported by said header body, and each of said second resilient contact portions experience a wiping engagement with one of said studs.

17. A system according to claim 1 wherein said connector ground contact means comprises electrically conductive means that covers a substantial surface portion of said connector housing so as to provide electrical shielding for the signal wires and contacts retained thereby.

18. A system according to claim 17 wherein said electrically conductive means comprises an electrically conductive coating that covers substantially the entire outer surface of said connector housing.

19. A system according to claim 18 wherein said header ground contact means comprises a fixed contact means adapted for connection to a circuit board chassis, and a bridge contact means for connecting said fixed contact means to said connector ground contact means.

20. A system according to claim 19 wherein said header means comprises a header body for receiving said connector housing, and a latching means movable into a latching position engaging said connector housing after reception thereof by said header body; said bridge contact means is retained by said latching means and movable therewith; and said movement of said latching means into said latching position produces movement of said bridge contact means into contact with said connector ground contact means.

21. A system according to claim 20 wherein said movement of said latching means into said latching position also produces movement of said bridge contact means into contact with said fixed contact means.

22. A system according to claim 21 wherein said bridge contact means and said connector ground contact means are shaped and arranged to experience a wiping engagement in response to said movement of said latching means into said latching position.

23. An electrical interconnection system comprising:

an elongated cable comprising a plurality of longitudinally extending electrically isolated signal wires and an insulator covering therefor;

an electrically conductive shield means overlying said cable so as to electrically shield said signal wires;

a plug-in connector housing secured to one end of said shielded cable;

a plurality of connector contacts retained by said housing and each connected to one of said signal wires;

a header means shaped and arranged to receive and retain said connector housing;

a plurality of header contacts retained by said header means and each positioned so as to engage one of said connector contacts upon reception of said connector housing by said header means;

connector ground contact means disposed externally on said connector housing and connected to said conductive shield means;

header ground contact means supported by said header means and shaped and arranged to engage said connector ground contact means upon reception of said connector housing by said header means; and force producing means movable into a position that induces and maintains contact force between said connector ground contact means and said header ground contact means with said connector housing retained by said header means.

24. A system according to claim 23 wherein said header ground contact means comprises a fixed contact means adapted for connection to a circuit board chassis, and a bridge contact means for connecting said fixed contact means to said connector ground contact means; and said force producing means produces said contact force by forcing said bridge contact means into forced engagement with said connector ground contact means.

25. A system according to claim 24 wherein said header means comprises a header body for receiving said connector housing; said force producing means and said header means comprise a latching means movable into a latching position engaging said connector housing after reception thereof by said header body; said bridge contact means is retained by said latching means and movable therewith; and said movement of said latching means into said latching position produces movement of said bridge contact means into contact with said connector ground contact means.

26. An electrical connector system for use with a cable having a plurality of signal wires and a conductive shield therefor, said system comprising:

a plug-in connector housing adapted to receive the shielded cable;

a plurality of connector contacts retained by said housing and each shaped and arranged for connection to one of the signal wires;

a header means shaped and arranged to receive and retain said connector housing;

a plurality of header contacts retained by said header means and each positioned so as to engage one of said connector contacts upon reception of said connector housing by said header means;

connector ground contact means disposed externally on said connector housing and adapted for connection to the conductive shield;

header ground contact means supported by said header means; and bridge contact means comprising a pivotally supported mid-portion and opposite ends that move respectively into forced engagement with said connector ground contact means and said header ground contact means with said connector housing retained by said header means.

27. A system according to claim 26 wherein said header ground contact means comprises a fixed contact means adapted for connection to a circuit board chassis, and said bridge contact means is supported by said header means.

28. A system according to claim 27 wherein said header means comprises a header body for receiving said connector housing, and a latching means movable into a latching position engaging said connector housing after reception thereof by said header body; said bridge contact means is retained by said latching means and movable therewith; and said movement of said latching means into said latching position produces movement of said bridge contact means into contact with said connector ground contact means and said header ground contact means.

* * * * *